US006862751B1

(12) United States Patent
Wattenbarger et al.

(10) Patent No.: US 6,862,751 B1
(45) Date of Patent: Mar. 8, 2005

(54) GO-KART CHEST PROTECTOR

(76) Inventors: April Wattenbarger, 7801 Penny Marie Ave., Bakersfield, CA (US) 93308; Pat Callahan, 6201 Summer Ct., Bakersfield, CA (US) 93308

( * ) Notice: Subject to any disclaimer, the term of this patent is extended or adjusted under 35 U.S.C. 154(b) by 0 days.

(21) Appl. No.: 10/727,743

(22) Filed: Dec. 4, 2003

(51) Int. Cl.[7] ..... A41D 13/00
(52) U.S. Cl. ..... 2/463
(58) Field of Search ..... 2/455–456, 459–465, 2/467, 92, 2.5, 44, 45, 268, 908, 114

(56) References Cited

U.S. PATENT DOCUMENTS

| | | | | | |
|---|---|---|---|---|---|
| 3,135,961 | A | * | 6/1964 | Roderick | 2/463 |
| 4,100,620 | A | | 7/1978 | Pecoraro | |
| 4,397,636 | A | * | 8/1983 | Ganshaw | 441/65 |
| 4,441,211 | A | * | 4/1984 | Donzis | 2/459 |
| 4,525,875 | A | | 7/1985 | Tomczak | |
| 4,847,913 | A | | 7/1989 | Chen | |
| 4,872,215 | A | | 10/1989 | Sliger | |
| 4,993,076 | A | | 2/1991 | Dierickx | |
| 5,226,192 | A | * | 7/1993 | Jones et al. | 2/461 |
| 5,325,537 | A | * | 7/1994 | Marion | 2/462 |
| 5,465,423 | A | * | 11/1995 | Taylor-Varney | 2/462 |
| 5,465,424 | A | * | 11/1995 | Cudney et al. | 2/462 |
| 5,524,641 | A | * | 6/1996 | Battaglia | 128/846 |
| 5,546,602 | A | | 8/1996 | Hale | |
| 5,623,729 | A | * | 4/1997 | Chen | 2/461 |
| 5,701,611 | A | | 12/1997 | Rector | |
| 5,950,249 | A | | 9/1999 | Clement | |
| 5,978,961 | A | | 11/1999 | Barker | |
| 6,012,162 | A | | 1/2000 | Bullat | |
| 6,035,453 | A | | 3/2000 | Cain | |
| 6,138,277 | A | | 10/2000 | Gillen et al. | |
| 6,161,226 | A | | 12/2000 | Serewocz et al. | |
| 6,314,578 | B1 | | 11/2001 | Masuda et al. | |
| 6,375,537 | B1 | | 4/2002 | Jankowski | |
| 6,446,273 | B1 | | 9/2002 | Gillen et al. | |
| 6,485,446 | B1 | * | 11/2002 | Brother et al. | 602/20 |
| 6,510,559 | B1 | | 1/2003 | Linares | |
| 6,510,560 | B1 | | 1/2003 | Ugolnik | |
| 6,560,789 | B2 | | 5/2003 | Whalen et al. | |
| 2002/0133867 | A1 | | 9/2002 | Lee | |
| 2002/0162162 | A1 | | 11/2002 | Collins | |

* cited by examiner

*Primary Examiner*—Tejash Patel
(74) *Attorney, Agent, or Firm*—Stetina Brunda Garred & Brucker

(57) ABSTRACT

A go-kart chest protective device is disclosed that is comprises of a conventional shirt-type garment having a protective element affixed thereto. The protective element is fabricated from an impact resistant material and is operative to selectively protect the chest of the go-kart driver without interfering with the driver's ability to drive the go-kart.

15 Claims, 1 Drawing Sheet

GO-KART CHEST PROTECTOR

CROSS-REFERENCE TO RELATED APPLICATIONS

Not Applicable

STATEMENT RE: FEDERALLY SPONSORED RESEARCH/DEVELOPMENT

Not Applicable

BACKGROUND OF THE INVENTION

The sport of go-kart racing is well-known in the art and enjoyed extensively throughout the world, particularly in the United States and Europe. Along these lines, a significant number of organizations and associations are dedicated to promoting the sport of go-kart racing, whether it be amateur or professional. Exemplary of such organizations include the World Karting Association, which establishes rules and procedures for the sport of go-kart racing and conducts annual championships for various types of karting, and the International Kart Federation, which has been actively involved in governing the sport of karting since the 1950's.

In this respect, the sport of go-kart racing has tremendous appeal for both children and adults, irrespective of driving skill level. To address such need there is a wide variety of go-karts are commercially available, ranging from yard karts or fun karts, which are basic go-karts made for fun and recreation, to high performance go-karts that are provided with specialized accessories and designed for competitive use. With respect to the latter, go-karts may be specially configured for use in a variety of applications, such as off road use or drag racing.

Despite such versatility, however, virtually all go-karts essentially have the same type of frame construction. In this regard, virtually all go-karts typically include a miniaturized frame, which is typically configured to seat a single driver within very close confines, that is mounted upon four small-radius tires and driven by a small horsepower engine, such as those produced by Briggs and Stratton of Milwaukee, Wis.

Such frame design, however, is well-known to create significant spatial constraints that substantially minimize the driver's ability to maneuver within the vehicle. Similarly, such frame design is known to prohibit or fail to accommodate any type of additional equipment to enhance the safety and operation of the go-kart. As a consequence, conventional go-kart construction presents a considerable risk to drivers to the extent the go-kart is ever involved in any type of collision, whether it be with another go-kart or stationary object. In this respect, by virtue of the miniaturized frame design, most karts typically lack any type of safety apparatus, such as air bags, reinforced framing, and the like. Moreover, to attempt to include such safety apparatus as part of the conventional go-kart design would detract from the sport by substantially increasing the size and weight of the go-kart.

On the other hand, it is likewise not practical to attempt to utilize what little space is afforded within the frame of the go-kart insofar as to include additional safety features can substantially interfere with the driver's ability to properly maneuver the vehicle, obstruct the driver's vision, or otherwise cause the driver to assume an awkward or uncomfortable position. In this regard, it is well-known that conventional safety gear, such as full motocross attire utilized in the sport of motorcycle racing, is far to bulky and substantially interferes with the driver's ability to drive the go-kart. Such problem particularly exists with the use of protective jackets and the like that are operative to provide protection completely about the arms, chest, back and ribs of the driver. Despite the extensive coverage provided by such racing jackets, the ability of such jackets to interfere with the driver's ability to drive the go-kart can even pose a greater risk in potentially causing an accident than to provide protection in case of an accident. As a consequence, because of such shortcomings associated with providing proper safety for the drivers of go-karts, especially with drivers involved in competitive go-kart racing and the like, a significant number of injuries, and even fatalities continue to frequently occur.

Accordingly, there is a substantial need in the art for a safety mechanism, and in particular a safety device that can provide the driver of a conventional go-kart with a substantially enhanced degree of protection from injury that does not interfere with the driver's ability to drive the go-kart and likewise does not interfere with the spatial confines of the go-kart frame within which the driver is seated. There is additionally a need in the art for such a safety device that is of exceedingly minimal construction, simple and easy to use, inexpensive to manufacture, and capable of being readily implemented by go-kart drivers for use while driving virtually all existing types of go-karts.

BRIEF SUMMARY OF THE INVENTION

The present invention specifically addresses and alleviates the above-identified deficiencies in the art. In this regard, the present invention is directed to a go-kart chest protector that is operative to provide a substantial degree of protection to the chest or thorax of the driver and, optionally, the upper abdomen of the driver while at the same substantially minimizing, if not eliminating, any hindrance to the driver that would otherwise affect the driver's ability to drive the go-kart. To that end, the chest protector of the present invention is designed to be exceptionally space efficient and likewise does not interfere with the limited confines of the go-kart frame within which the driver is seated.

According to a preferred embodiment, the go-kart chest protector of the present invention is preferably formed as a shirt-type garment fabricated from conventional materials such as cotton, nylon or any other natural and/or synthetic materials well-known in the art. Along these lines, the garment is preferably configured as either a conventional long sleeve, short sleeve or vest/tank-top shirt. Formed upon or otherwise attached to the chest area of the garment is a protective element, which may take any of a variety of forms well-known to those skilled in the art. In this respect, the protective element will be formed from a material capable of withstanding blunt force or otherwise protect the driver from impact directed to the driver's chest and/or lower abdomen, and is particularly configured to protect the driver against impact against the go-kart steering wheel. Exemplary of such materials utilized to form the protective element include hardened plastic, foam, and combinations thereof.

The protective element is configured so that it selectively protects key anatomical structures about the chest of the driver while not interfering with the driver's ability to move and/or extend his or her arms in order to operate (i.e., steer) the go-kart. Specifically, the protective element will be configured to provide a protective area over the clavicle bones, sternum and frontal portions of the ribs to thus protect vital organs such as the heart and lungs of the driver against impact. Optionally, the protective element may extend about the upper abdomen to thus provide protection of the live, stomach, spleen and diaphragm, as well as portions of the small and large intestines. To minimize interference with the driver wearing the chest protector, the protective element is provided with tapered sections that extend inwardly from the driver's pectoralis major muscles and beneath the driver's neck, and specifically the sternocleidomastoid muscles of the driver. In an alternative embodiment operative to provide greater lateral protection for the ribs, the protective element may further include rearwardly extending side wall portions operative to extend generally about the false ribs, (namely, the eighth to tenth ribs) and floating ribs, (namely, the eleventh and twelfth ribs). Importantly, the protective element does not extend upon or over the shoulders, arms, back and lower abdomen of the driver insofar as it has been recognized that to cover such areas will substantially interfere with the driver's ability to drive and further, that such areas of the driver's body, in the context of go-kart racing, are at substantially reduced risk for injury.

As per conventional garments, the go-kart chest protector may be provided with any type of fastening means to facilitate wearing and/or removing the same. Specifically, the go-kart chest protector of the present invention may be provided with buttons, snap fasteners, zippers, or hook and loop fasteners that may be designed per a variety of configurations known in the art. In this respect, the go-kart chest protector of the present invention may be configured per a variety of conventional sizes, such small, medium, large, extra large, to thus enable the same to be readily adapted for a particular individual, whether it be a child or an adult, male or female.

BRIEF DESCRIPTION OF THE DRAWINGS

These as well as other features of the present invention will become more apparent upon reference to the drawings.

DETAILED DESCRIPTION OF THE INVENTION

The detailed description set forth below is intended as a description of the presently preferred embodiment of the invention, and is not intended to represent the only form in which the present invention may be constructed or utilized. The description sets forth the functions and sequences of steps for constructing and operating the invention. It is to be understood, however, that the same or equivalent functions and sequences may be accomplished by different embodiments and that they are also intended to be encompassed within the scope of the invention.

Figure 1:
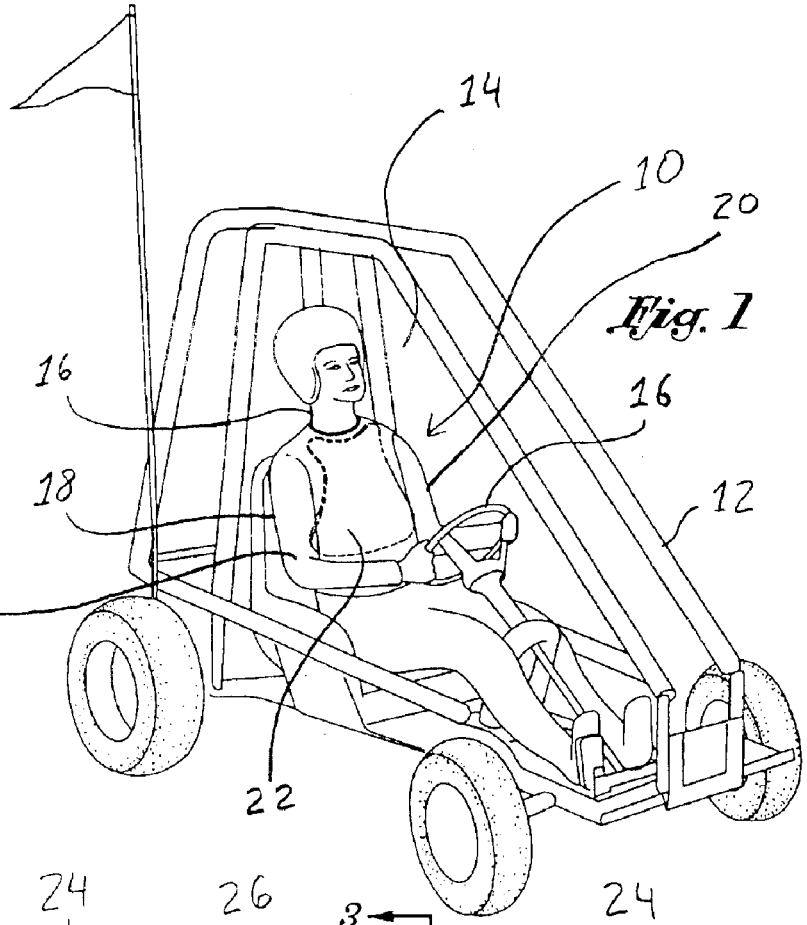
FIG. 1 is a perspective view of a driver driving a go-kart wherein the driver is wearing a go-kart chest protector constructed in accordance with a preferred embodiment of the present invention.

Referring now to the drawings, and initially to FIG. 1, there is shown a go-kart chest protector 10 operative to provide protection to the chest, and optionally the chest and upper abdomen, of a driver 16 of a go-kart 12. With respect to the latter, the construction of go-karts, such as 12, is well-known to those skilled in the art. In this respect, virtually all types of go-karts are provided with a miniaturized frame defining a limited driving space 14 within which the driver 16 is seated while operating the go-kart. Problematic with such construction, however, is the limited structure available to protect the driver 16 in case of a collision, whether it be with another moving vehicle or a stationary object. While the risk of collision can occur anywhere about the go-kart, it is unquestionable that the biggest risk posed by conventional go-kart frame design is that of the steering wheel 16 to impact directly with the chest of the driver, which often times can be fatal.

The go-kart chest protector 10 of the present invention specifically addresses such shortcomings by providing a focused degree of protection directly about the chest of the driver 16 while at the same substantially minimizing, if not eliminating, any hindrance to the driver 16 that might otherwise interfere with the driver's ability to maneuver the go-kart 12. In this regard, the go-kart chest protector 10 comprises a shirt-type garment portion 24 fabricated from a conventional fabric, such as cotton, nylon, or any other natural and/or synthetic material well-known to those skilled in the art, upon which is formed a protective element 22, the latter being operative to provide an impact resistant shield to thus protect the chest of the driver 10 in the event of a collision, and specifically in the event of an impact with the steering wheel 16 of the go-kart 12. The protective element 22 is further configured so as not to interfere with the driver's ability to maneuver the go-kart 12, and in particular does not interfere with the movement of the driver's arms 18, 20 to freely grasp and turn steering wheel 16, which is essential, especially during go-kart racing competition.

Figure 2:
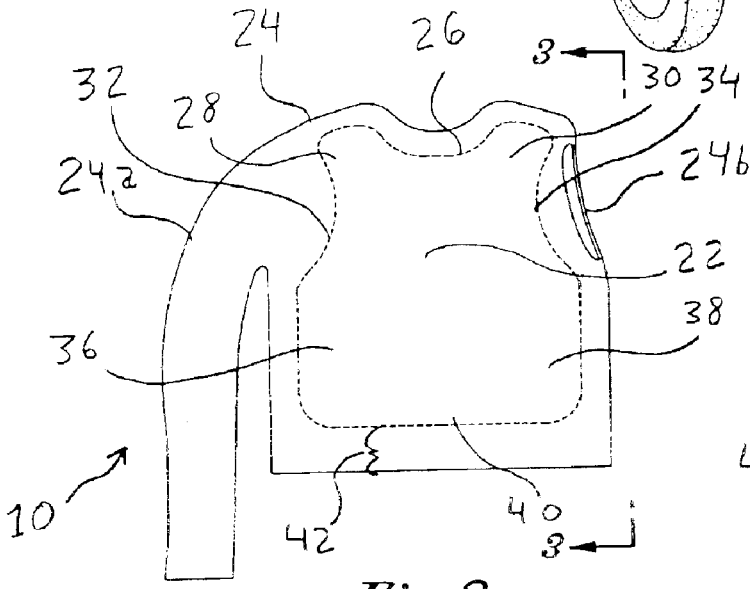
FIG. 2 is a frontal view of the go-kart chest protector of the present invention depicting both a long sleeved embodiment (left side) and vest-type embodiment (right side).

Referring now to FIG. 2, the go-kart chest protector 10 is shown with the left side thereof depicting a first embodiment, and the right side thereof depicting another embodiment. As discussed above, the go-kart chest protector 10 comprises a conventional shirt type garment 24, which may be fabricated to include long sleeves, such as the left side portion 24*a* of FIG. 2, or configured as a vest or tank top garment as depicted in the right side 24*b* portion of FIG. 2. It will also be readily appreciated that the garment 24 may be fabricated as a short sleeve garment, as per conventional T-shirts and the like, or otherwise fabricated per any shirt-type garment well-known to those skilled in the art. Along these lines, it should expressly be noted that in the practice of the present invention the garment portion 24 will be fabricated such that portions of such garment covering the back, arms, shoulders, and lower abdomen will comprise nothing more than one or more layers of material only and will not be provided with any type of protective padding, coverings or any type of impact resistant shielding, as is frequently employed in protective jackets and the like utilized in the motorcycle/motocross racing.

This latter feature is particularly important and specific to the sport of go-kart racing insofar as the chest protector 10 seeks to attain as a primary objective thereof the ability to provide a chest protective device that does not interfere with the driver's ability to maneuver the go-kart. In this regard, to utilize conventional motocross racing jackets and the like can and does interfere with the driver's ability to drive a go-kart insofar as the same are exceptionally bulky and restrict the driver's ability to maneuver his or her arms while steering, based primarily upon the differences between steering the handlebars of a motorcycle versus the steering wheel of a go-kart. Additionally, because such conventional motocross jackets are exceptionally thick and include padding extending upon the shoulders, arms and back of the driver, use of such jackets often forces the driver to assume an extremely awkward and uncomfortable position insofar as the driver has extremely limited space to sit within the go-kart, as discussed above. Accordingly, by utilizing a simple garment structure that does not provide any type of protective covering about the back, shoulders and/or arms of the driver, the driver is thus able to fully operate the go-kart without any type of obstruction.

With respect to protective aspects of the go-kart chest protector 10 of the present invention, there is provided a protective element 22 that is attached to or otherwise formed upon the chest portion of the garment 24. As will be appreciated by those skilled in the art, such attachment may take any form that is known or later developed, and can include techniques such as stitching, gluing, or fastening by any known means. The protective element 22 is designed and configured to provide protection about a select portion of surface area extending about the chest of the driver. In this regard, the protective element 22 is configured to only protect those portions of the chest and, optionally, lower abdomen, of the driver that are most at risk in the event the go-kart is involved in a generally head-on collision but at the same time minimizes structure to thus minimize interference with the driver's ability to drive the go-kart. To that end, the protective element 22 is provided with upwardly extending portion 28, 20 that are operative to cover the clavicle bones of the driver. Such portions are specifically configured such that the same do not extend over or otherwise encroach upon the tops of the shoulders of the driver, insofar as to provide such structure will interfere with the driver's ability to drive the go-kart.

Similarly, there is provided a recessed portion 26 disposed between extending portions 28, 30 that is operative to extend below the neck, and in particular the sternocleidomastoid muscle groups so as to not interfere with the driver's ability to turn his or her head or otherwise compress against the driver's throat.

In order to minimize interference with the driver's arms, which must necessarily extend outward to grasp the steering wheel 16, as depicted in FIG. 1, the protective element 22 is provided with opposed recessed portions 32, 34, extending generally across the pectoralis major muscles to thus enable the driver's arms to extend forward without compressing against the protective element 22.

Extending downwardly from the recessed portions 32, 34 are rib protective portions 36, 38 that extend about the front of the driver's rib cage. As will be appreciated by those skilled in the art, such rib protective portions 36, 38 may be selectively sized and configured to protect only the front portion of the rib cage, or alternatively, may include a rearwardly extending sidewall portions, such as 38*a* depicted in FIG. 3, which are operative to provide lateral protection to lower ribs. Specifically, it is contemplated that such rearwardly extending sidewall portions will be operative to provide protection for at least the eighth to tenth ribs (also known as the false ribs) as well as the eleventh and twelfth ribs (known as the floating ribs). Importantly, however, to the extent the protective element 22 is configured to provide lateral protection to the ribs, it should be understood that the protective element 22 will be formed such that the same does not interfere with the driver's ability to move his or her arms while operating the go-kart.

The protective element 22 is further sized such that the same will extend across the chest via portion 40. With respect to the latter, such portion may be selectively sized such that the same extends only across the chest or thorax of the driver or may be selectively lengthened such that the same extends generally across the upper abdomen or diaphragm of the driver. Likewise, such portion 40 may be sized to accommodate the breasts of a female driver. To the extent portion 40 simply covers the chest portion of the driver, the protective element will thus have a minimized surface area that will minimize driving interference. Alternatively, to the extent the portion 40 extends about the upper abdomen, the same will impart a higher degree of protection to additional internal organs of the driver, such as the liver, stomach and spleen. In all such embodiments, however, it should be understood that at least a length 42 should exist between portion 40 and the bottom of the garment 24 to thus ensure that the protective element 22 does not interfere or otherwise compress against the lower abdomen and/or upper thighs of the driver while the driver is operating the go-kart.

Figure 3:
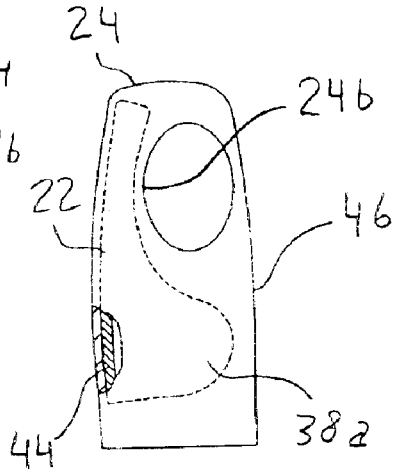
FIG. 3 is a side view taken along line 3—3 of FIG. 2.

With respect to the protective element 22, the same may be fabricated from any of a variety of materials well-known to those skilled in the art. In this regard, protective element 22 may be formed from molded, impact-resistant plastic or otherwise be formed from cushioning material, such as compressive foam, that is operative to withstand and absorb the force of an impact, particularly the impact sustained from the steering wheel of the go-kart. As illustrated in FIG. 3, in one preferred embodiment the protective element 22 will be fabricated from a combination of a molded plastic outer shield portion having cushioning material underneath to not only resist a blunt force impact, but also impart a cushioning effect to the chest and/or upper abdomen of the driver.

Additional modifications and improvements of the present invention may also be apparent to those of ordinary skill in the art. For example, it should be readily appreciated that protective element 22 may be formed from any type of material or take any type of configuration that is operative to protect the select anatomical structures of the driver as discussed above. Likewise, it should be understood that protective element may be secured to the garment portion 24 via any well-known means in the art and may further be configured to be detachable in nature to thus enable the same to be interchangeably utilized with other shirt-type garments constructed in accordance with the principles herein. Thus, the particular combination of parts and steps described and illustrated herein is intended to represent only certain embodiments of the present invention, and is not intended to serve as limitations of alternative devices and methods within the spirit and scope of the invention.

What is claimed is:

1. A go-kart chest protective device comprising:

(a) a shirt garment; and (b) a protective element affixed to said shirt garment, said protective element being fabricated from an impact resistant material and formed to have a configuration operative to selectively define a limited protective barrier defining a continuous peripheral edge extending below the shoulders and over the clavicle bones, sternum and frontal portion of the rib cage of an individual when said individual wears said shirt garment.

2. The go-kart chest protective device of claim 1 wherein said shirt garment is fashioned as a long sleeved garment.

3. The go-kart chest protective device of claim 1 wherein said shirt garment is fashioned as a short-sleeved garment.

4. The go-kart chest protective device of claim 1 wherein said shirt garment is fashioned as a vest type garment.

5. The go-kart chest protective device of claim 1 wherein said shirt garment is fabricated from a material selected from the group consisting of a natural material and a synthetic material.

6. The go-kart chest protective device of claim 1 wherein said garment material is provided with a single layer of material extending across the back of said wearer when worn thereby.

7. The go-kart chest protective device of claim 1 wherein said protective element is fabricated from hardened plastic.

8. The go-kart chest protective device of claim 1 wherein said protective element is fabricated from a compressive foam material.

9. The go-kart chest protective device of claim 1 wherein the protective element is fabricated from a shell of hardened plastic having a foam material disposed therebehind.

10. The go-kart chest protective device of claim 1 wherein said protective element is further operative to extend about the upper abdomen of the individual when said shirt garment is worn by said individual.

11. The go-kart chest protective device of claim 1 wherein said protective element is stitched to said shirt garment.

12. The go-kart chest protective device of claim 1 wherein said protective element is adhesively attached to said shirt garment.

13. The go-kart chest protective device of claim 6 wherein said protective element further defines a peripheral edge having recessed portions extending toward the pectoralis major of said individual wearing said shirt garment.

14. The go-kart chest protective device of claim 13 wherein said protective element further includes rearwardly extending side wall portions operative to provide a protective barrier approximately about the eighth to twelfth ribs of said individual.

15. The go-kart chest protective device of claim 1 wherein said protective element is detachably fastenable to said shirt garment.

* * * * *